United States Patent [19]

Tayler

[11] 4,441,855

[45] Apr. 10, 1984

[54] COMPRESSORS

[75] Inventor: Colin A. M. Tayler, Bath, England

[73] Assignee: The Secretary of State for Defence in Her Britannic Majesty's Government of the United Kingdom of Great Britain and Northern Ireland, London, England

[21] Appl. No.: 242,566

[22] Filed: Mar. 11, 1981

[30] Foreign Application Priority Data

Mar. 20, 1980 [GB] United Kingdom ..... 8009450

[51] Int. Cl.[3] ..... F04D 5/00

[52] U.S. Cl. ..... 415/53 T; 415/56; 415/198.2

[58] Field of Search ..... 415/52–59, 415/198.2, 213 T

[56] References Cited

U.S. PATENT DOCUMENTS

| | | | |
|---|---|---|---|
| 745,409 | 12/1903 | Zahikjanz | 415/56 |
| 1,024,920 | 4/1912 | Atwood | 415/57 |
| 2,217,211 | 10/1940 | Brady | 415/53 T |
| 3,095,820 | 7/1963 | Sanborn et al. | 415/53 T |
| 3,869,220 | 3/1975 | Tayler | 415/56 |
| 4,325,672 | 4/1982 | Sixsmith et al. | 415/198.2 X |

FOREIGN PATENT DOCUMENTS

| | | | |
|---|---|---|---|
| 1085418 | 10/1965 | United Kingdom . | |
| 1237363 | 6/1971 | United Kingdom | 415/56 |
| 2036178 | 11/1978 | United Kingdom . | |

*Primary Examiner*—Philip R. Coe

*Attorney, Agent, or Firm*—Cushman, Darby & Cushman

[57] ABSTRACT

In an axial flow rotary compressor a fluid flow inlet is circumferentially separated from a fluid flow outlet by a dynamic flow splitter comprising at least one toroidal chamber providing a loop fluid flow path intersecting the path of the rotor blades such that any fluid leakage through the flow splitter flows around the loop flow path. Regeneration of the flow through the rotor blades as they emerge from the flow splitter is thus facilitated. The flow splitter may comprise a number of contiguous chambers whose apertures can increase towards the low pressure end of the flow splitter to compensate for the decreased density of the fluid. The downstream walls of the flow splitter chambers can be offset relative to the upstream walls so as to provide a direct quasi-helical fluid flow path through the flow splitter to increase the enthalpy transport through the flow splitter.

6 Claims, 5 Drawing Figures

COMPRESSORS

The invention relates to compressors and particularly to compressors requiring high pressure ratios and/or low mass flows for refrigeration and cryogenic pumping.

In cryogenics, pneumatics for instrumentation or control and refrigeration applications in which high pressure ratios and very low flow rates are required, pumping has been carried out by reciprocating compressors but because of the size, weight and the problem of oil contamination associated with these compressors alternative pumping solutions have been sought.

Recently a multistage centrifugal compressor for cryogenic duties in the production of liquid helium has been developed. Because of the low flows involved, the size of each unit is very small and a high rotational speed (up to 200,000 rpm) is required. No suitable prime mover for industrial use is widely available, and such prime movers have proved difficult to develop.

A convenient means of meeting part load requirements from axial flow turbomachinery has been to restrict the flow annulus segmentally. The rotating blades upon entering a restricted region are cut off from their supply of fluid thereby reducing the total flow and power output, at the expense of a considerable fall in adiabatic efficiency, due to the turbulence generated as the moving blades enter and leave the stagnant region. However this provides a convenient and simple method of power control, for which the fall in efficiency is the accepted penalty.

Aerodynamic compressors of the regenerative and re-entry type (the latter is described in U.K. Pat. No. 1,420,600-Rotary Bladed Compressors) utilise a segmentally blocked region to separate the inlet fluid flow from the outlet flow, and in the re-entry compressor to also separate the flow passages between successive passes through the rotating blading.

In regenerative compressors utilising only one splitter to divide the inlet from the outlet flow, the dynamic pressure head is generated in a free flow system between the rotating blading and its surrounding casing. There will therefore be a time lag for the flow to regenerate within the blading when emerging from the stagnant static splitter region, and this would account for a large part of the low efficiency and pressure rise attainable from this type of machine, since the flow at entry is effectively throttled. In one form of re-entry compressor which has been tested there were seven flow passes through the rotating blades necessitating six "splitters" dividing the flow passes and one separating the inlet from the outlet flow. In this compressor it was discovered that the compressor produced neither the expected design flow nor the pressure rise required. Thus experience has shown that the effect of stopping the flow between static segmental flow splitters in compressors of the regenerative and re-entry type is to destroy the flow in the following open passage due to the time taken for the flow to regenerate.

The object of the present invention is to provide an arrangement which will effectively separate an inlet fluid flow to the blades of a compressor from an outlet flow without causing the fluid flow within the blades to stop.

The invention comprises an axial flow rotary compressor having a rotor provided with a multiplicity of blades distributed around its periphery for rotation between a row of upstream stator blades and a row of downstream stator blades and having disposed adjacent to the rotor blades at least one fluid inlet duct, at least one circumferentially spaced fluid outlet duct and a flow splitter positioned between a fluid inlet duct and a fluid outlet duct, wherein the flow splitter comprises at least one duct providing a loop fluid flowpath intersecting the path of the rotor blades such that there is a continuous fluid flow through the rotor blades as the blades pass the flow splitter. Thus in a regenerative compressor the flow splitter is provided between the input flow duct and the outlet flow duct to separate these flows by a flow splitter which acts dynamically and in the case of a re-entry compressor where the fluid is ducted to make a plurality of passes through different circumferential portions of the rotor blades each flow pass through the blades may be separated by a dynamic flow splitter.

The flow splitter may be formed by a plurality of contiguous chamber circumferentially positioned around a portion of the rotor. Each chamber then defines a duct for a loop fluid flowpath.

Preferably the loop fluid flowpath comprises an arcuate loop which intersects the blades of the rotor and whose axis is generally tangential of the rotor. In one form the upstream and downstream end of the or each duct is within the flow splitter are so positioned that the fluid ejected from the rotor blades into the downstream end of a flow splitter duct flows in a closed loop through the duct to the upstream end of the duct, and back to the downstream end of the duct via the rotor blades.

Preferably the walls of each chamber defining a loop fluid flowpath in the form splitter have radially extending partition walls so formed as to direct the fluid flow passing through the rotor blades in a similar manner to the flow directed by the stator blades. By this means the fluid flow stream lines through the rotor blades are the same within the flow splitter as in the fluid pass regions of the rotor blades.

In another form the ends of each duct within the flow splitter may be so formed and positioned that the downstream end of a duct is offset relative to the upstream end of the duct to provide a quasi-helical path through the flow splitter for a predetermined portion of the fluid flow. The degree of offset of the partitions then determines the amount of flow following the quasi-helical path through the flow splitter. By thus providing an additional helical duct flow, enthalpy generated within the flow splitter is removed by the helical flow to supplement that carried over by the rotating blades. The separation of the partition walls and the area of the ducts may be increased towards the low pressure side of the flow splitter to compensate for the decreasing density of the fluid towards the low pressure side.

The invention will now be described by way of example only with reference to the following drawings of which:

Figure 1:
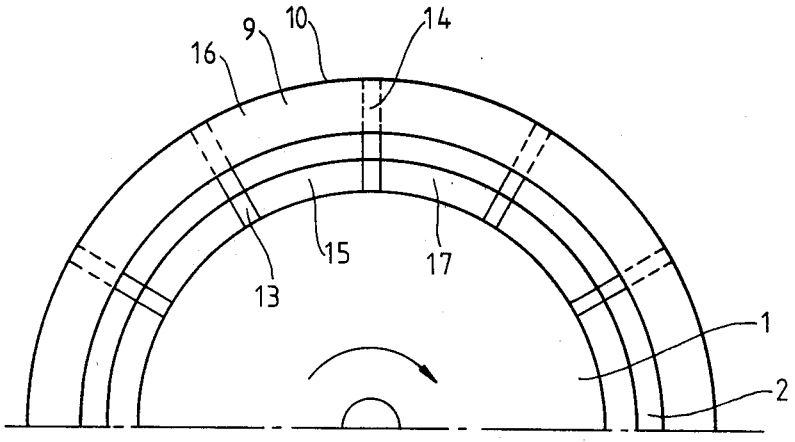
Fig. 1. (PRIOR ART)
FIGS. 1 and 2 are axial and sectional views of a known re-entry axial flow compressor.
Figure 2:
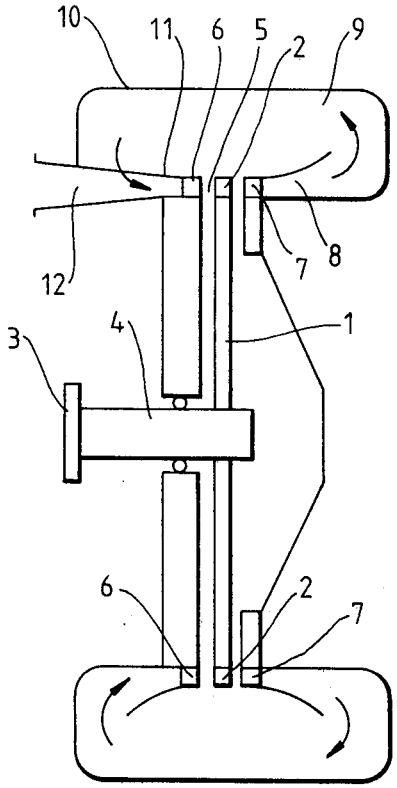
Fig. 2. (PRIOR ART)

FIGS. 1 and 2 show one schematic arrangement of an axial flow rotary re-entry compressor as is more fully described in U.K. Pat. No. 1,420,600. The compressor comprises a rotor 1 provided with a plurality of radially directed aerofoil sectional rotor blades 2 circumferentially distributed around the periphery of the rotor 1 with the rotor being turned by a prime mover connected to a flange 3 on the shaft 4 of the rotor 1. The rotor blades 2 operate in a space 5 known as the rotor blade passage, between a row of upstream stator blades 6 and a row of downstream stator blades 7, both of the rows of stator blades being disposed in an annular aperture 8 around the rotor 1. A toroidal space 9 disposed around the rotor blade passage 5 is formed by an outer case wall 10 and an inner wall 11 from which the stator blades 6 and 7 extend. The rotor blade passage 5 opens at both sides of the rotor 1 into the toroidal space 9. Low pressure fluid from a fluid source flows via a fluid inlet duct 12 in to the rotor blade passage 5 where it is compressed by the rotor 1 and on leaving the rotor blade passage 5 the compressed fluid enters the toroidal space 9. The toroidal space is so disposed that the compressed fluid flows there-through to an angularly separated segment of the rotor blade passage 5 where the fluid is re-compressed on a second passage through the rotor blades 2.

A plurality of similar toroidal passage spaces 9 are provided around the annular aperture 8 such that the fluid is recompressed several times before passing to an outlet duct of the compressor. The separate toroidal spaces 9 are separated by lateral walls 13 on the upstream side of the rotor blade passage 5 and 14 on the downstream side of the rotor blade passage. The lateral walls 13 and 14 are relatively offset and are disposed such that fluid enters the inlet aperture, passes through the rotor blade passage 5 and then enters aperture 16 of a toroidal space and is guided outside the rotor 1 to the adjacent inlet aperture 17. Thus there is a need to separate each flow path through the rotor blade passage.

Figure 3:
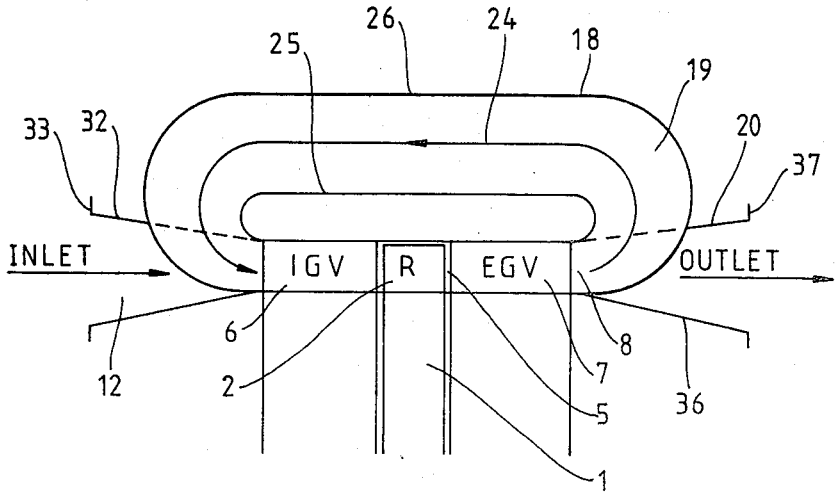
FIG. 3 is a diagrammatic part-sectional view of a flow splitter of a re-entry compressor according to the invention.
Figure 4:
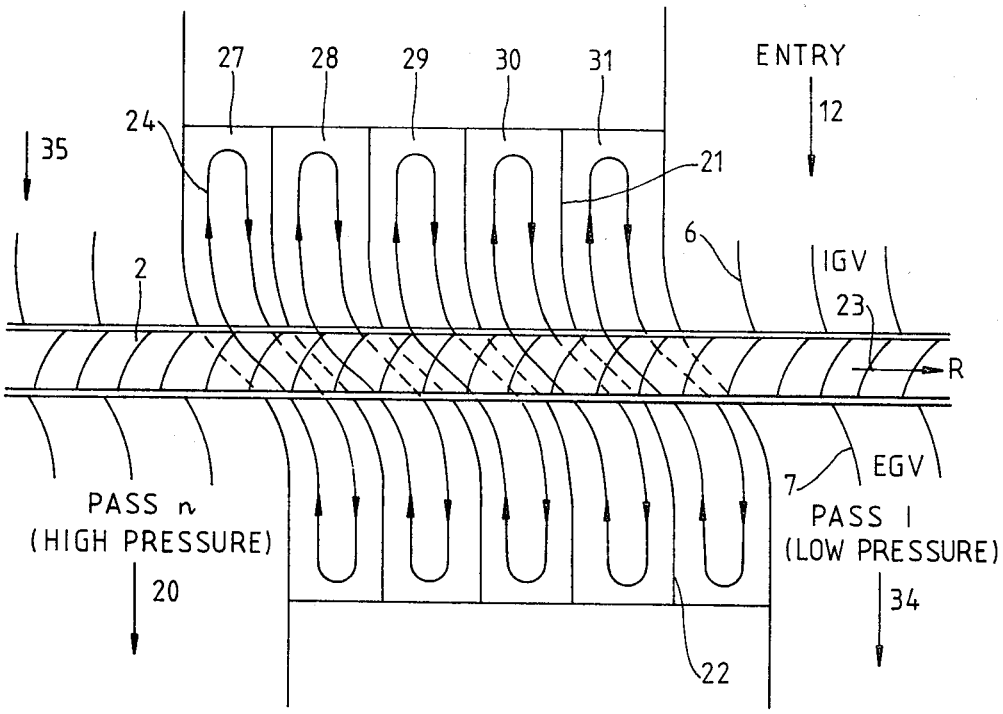
FIG. 4 is a developed view of the flow splitter of FIG. 3.

FIGS. 3 and 4 show one schematic arrangement of a dynamic flow splitter for separating an inlet fluid path to the rotor blades from an outlet fluid flowpath from the compressor. The flow splitter is a part-toroidal labyrinth 18 disposed outside the rotor blades 2 and forms a series of arcuate ducts 19 connected at both ends to the passage 5 as shown in section in FIG. 3. The flow splitter extends over a limited circumferential portion of the compressor between the inlet 12 and an outlet 20 from the compressor.

The labyrinth flow splitter 18 around the rotor 1 intersecting the rotor blades 2 is divided by a plurality of radially directed circumferentially distributed partitions 21 adjacent to the upstream stator blades 6, and 22 adjacent to the downstream stator blades 7. The partitions 22 are displaced relative to the partitions 21 in the direction of rotation 23 of the rotor 1. The partitions 21 and 22 divide the annular aperture 8 around the rotor 1 into a plurality of successively arranged arcuate flowpaths 24 each intersecting a portion of the row of rotor blades 2. Each partition 21 extends from the row of upstream stator blades 6 into the arcuate duct 19 and is continued to join the next following partition 22 which is similarly extended from the row of downstream stator blades 7 into the arcuate duct 19, the extended partitions 21 and 22 occupying the whole height between the inner wall 25 and the outer wall 26 of the labyrinth flow splitter 18. The displacement of the downstream partitions 22 relative to the upstream partitions 21 and their arcuate shapes are such that the fluid stream lines within the rotor blade passage in the flow splitter are of similar form to those in other fluid pass portions of the rotor blade passage. As shown the arcute flowpaths 24 each have the same aperture within the successive chambers 27–31 of the labyrinth 18.

Entry into the re-entry compressor is provided by the convergent inlet 12 extending outside the outer wall of the labyrinth flow splitter 18 and whose wall 32 terminates at a flange 33 to which a low pressure fluid source can be connected. After the first pass through the rotor blades 2 the fluid passes the row of downstream stator blades 7 and enters a flowpath 34 in a first toroidal space 9 by which it is returned to a second pass or portion of the upstream side of the rotor blade passage 5 via the row of upstream stator blades, the second pass portion of the rotor blade passage being adjacent to the first pass. A plurality of flowpaths are thus provided each leading from the downstream side of the rotor blade passage 5 to the upstream side. Downstream of the last flowpath 35 the fluid enters the divergent outlet passage 20 which extends outside the outer wall of the labyrinth flow splitter and whose wall 30 is formed with a flange 37 for connection to a high pressure fluid sink.

In use the row of rotor blades 2 is driven from left to right as shown in FIG. 4 when a fluid, such as helium gas, from a low pressure source enters the compressor through the convergent inlet 12 and passes through the row of upstream stator blades 6 into the rotor blade passage 5 intersected by the row of rotor blades 2. The fluid then passes the row of downstream stator blades 7 and after being compressed by a number of re-entry passes through the rotor blade passage 5, passes at high pressure to the outlet 20. Some of the high pressure fluid enters the first chamber 27 of the labyrinth flow splitter 18 which leads from the downstream stator blades 7 to the upstream stator blades 6. This fluid is forced into circulation around the flowpath 24 in the chamber 27 by the rotating blades. Some of this circulating flow of fluid then passes from the first chamber 27 to the second chamber 28 and in turn some fluid circulates seccessively through all the chambers of the labyrinth flow splitter 18.

The dynamic labyrinth flow splitter arrangement separates the fluid flow from the inlet 12 from the fluid flow to the compressor outlet 20, with the gradient between the high and low pressure being sealed by the labyrinth chambers 27–31 directing the flow as shown in FIG. 2. The only flow between the high and low pressure passages is the leakage necessary to establish the pressure gradient within the splitter, and the flow carried over by the blades in which the fluid expands in going from the high to the low pressure. However, energy will be expended on the recirculated fluid continuously as the rotating blades pass through the splitter region, and it is necessary to ensure that the enthalpy generated does not exceed the rate at which it can be removed by the carry-over flow. If the compressor pressure ration is relatively low, then the number of labyrinth chambers within the splitter will be small, resulting in a low generation of enthalpy relative to the carry-over flow. Thus the heat can be effectively removed by the fluid. However if the compressor is designed for a high pressure ratio, and if leakage rates between the high and low pressure (outlet and inlet respectively) are to be contained, then an increase in the number of labyrinth chambers will become necessary, and an increase in enthalphy will be generated for the same carry-over flow. To meet this situation the flow passes can be increased by "offsetting" the downstream labyrinth splitter partitions 22, relative to those upstream to thereby provide a continuous helical flow duct around the blades, increasing in cross-sectional area towards the low pressure end and to compensate for the reduction in density of the expanding fluid.

Figure 5:
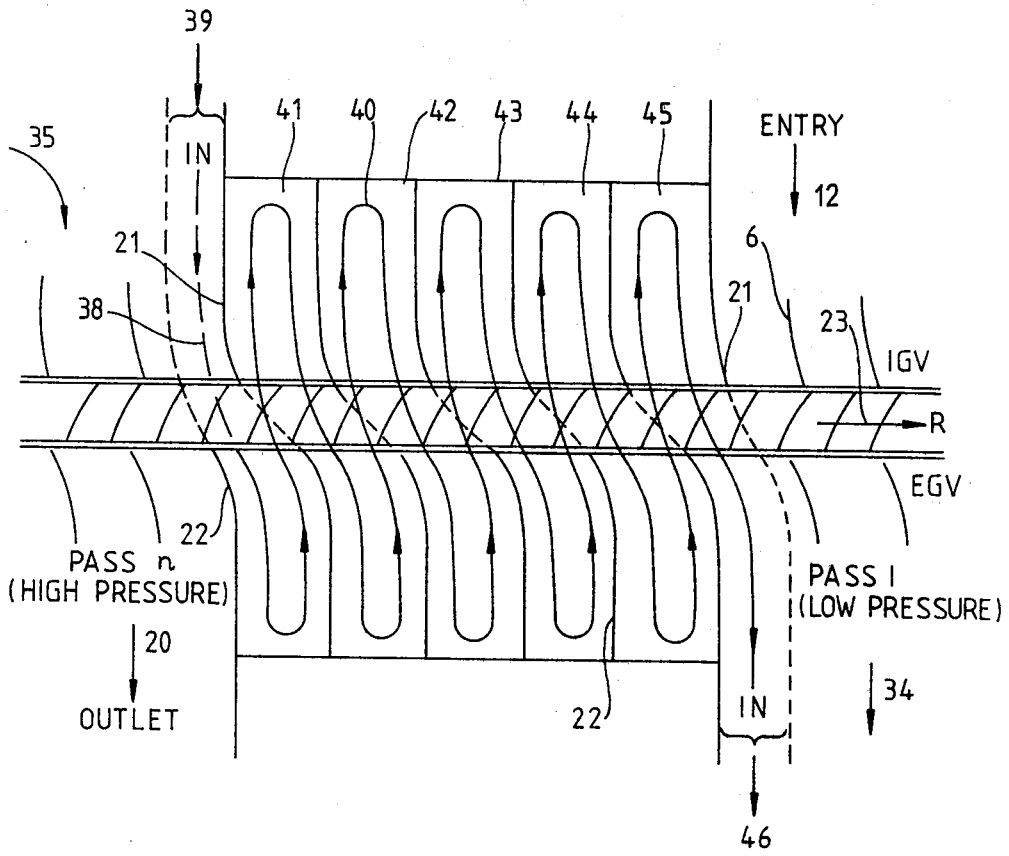
FIG. 5 is a developed view of a further arrangement of the flow splitter of FIG. 3.

FIG. 5 shows a modified arrangement of the labyrinth flow splitter. The upstream labyrinth partitions 21 are so shaped and disposed as to be offset from the downstream labyrinth partitions 22 when related to the fluid flow path 38 through the labyrinth. The offset 39 is selected to determine the amount of flow which follows a helical path 40 through the successive labyrinth chambers 41–45 of the flow splitter to emerge in the flow region 46 to supplement the flow carried over by the rotor blades 2 and to absorb the excess enthalpy generated within the splitter region when this exceeds that which can be removed by the flow carried over by the rotating blades. The pitch of the labyrinth partitions is increased from the high pressure end in chamber 41 to the low pressure end in chamber 45 to compensate for the reduction in density of the fluid. The enthalpy generated and the supplementary helical path flow contribute to a loss in the overall compressor efficiency, and therefore a balance between this and the labyrinth leakage is necessary as a compressor design consideration.

The dynamic labyrinth flow splitter arrangements shown in the combination of FIGS. 3 and 4 and FIGS. 3 and 5 provide a method of separating and sealing two or more flow passages at differing pressures without the severe penalties imposed by stopping the flow as in a conventional static splitter arrangement. The principle can be applied to the conventional regenerative compressor, but is a particular feature of the re-entry type compressor, where in addition to the need to separate the inlet from the outlet flows, each segmental flow passage through the rotating blades demands similar attention, to prevent breakdown of the established flow pattern. In the design stage, attempts should be made to keep the supplementary helical duct flow in a high pressure ratio design to a minimum, since this represents a direct loss. However the flow carried over is not entirely lost, since in expanding down to the lower pressure, work will be done on the blades and this is therefore partially recovered.

The number of labyrinth chambers in the flow splitter has been shown as five for the two embodiments described with reference to the figures. This number is merely illustrative of the invention and any convenient number can be selected to suit the required application of the compressor.

I claim:

1. An axial flow rotary compressor having a rotor provided with a multiplicity of blades distributed around its periphery for rotation between a row of upstream stator blades and a row of downstream stator blades and having disposed adjacent to the rotor blades at least one low pressure fluid inlet duct, at least one circumferentially spaced high pressure fluid outlet duct and a flow splitter positioned between a fluid inlet duct and a fluid outlet duct to separate the low pressure fluid from the high pressure fluid, wherein the flow splitter comprises a plurality of contiguous chambers positioned around a portion of the rotor, each chamber forming a duct for a loop fluid flowpath intersecting the path of the rotor blades such that in use there is a continuous fluid flow through the rotor blades as the blades pass the flow splitter.

2. An axial flow rotary compressor according to claim 1 wherein each chamber has radially extending walls so formed as to direct the fluid flow passing through the rotor blades in a similar manner to the flow directed by the upstream and downstream stator blades.

3. An axial flow rotary compressor having a rotor provided with a multiplicity of blades distributed around its periphery for rotation between a row of upstream stator blades and a row of downstream stator blades and having disposed adjacent to the rotor blades at least one low pressure fluid inlet duct, at least one circumferentially spaced high pressure fluid outlet duct and a flow splitter positioned between a fluid inlet duct and a fluid outlet duct to separate the low pressure fluid from the high pressure fluid, wherein the flow splitter comprises at least one duct providing a loop fluid flow path intersecting the path of the rotor blades such that in use there is a continuous fluid flow through the rotor blades as the blades pass the flow splitter, the upstream and downstream end of each duct within the flow splitter being so formed and positioned that in use the fluid ejected from the rotor blades into the downstream end of the flow splitter duct flows in a closed loop through the duct to the upstream end of the duct and back to the downstream end of the duct via the rotor blades.

4. An axial flow rotary compressor having more than one flow splitter duct according to claim 3 wherein the area of the ducts is increased towards the low pressure side of the flow splitter.

5. An axial flow rotary compressor having a rotor provided with a multiplicity of blades distributed around its periphery for rotation between a row of upstream stator blades and a row of downstream stator blades and having disposed adjacent to the rotor blades at least one low pressure fluid inlet duct, at least one circumferentially spaced high pressure fluid outlet duct and a flow splitter positioned between a fluid inlet duct and a fluid outlet duct to separate the low pressure fluid from the high pressure fluid, wherein the flow splitter comprises at least one duct providing a loop fluid flow path intersecting the path of the rotor blades such that in use there is a continuous fluid flow through the rotor blades as the blades pass the flow splitter, the ends of each duct within the flow splitter being so formed and positioned that the downstream end of the duct is offset relative to the upstream end of the duct to provide a quasi-helical fluid flow path through the flow splitter.

6. An axial flow rotary compressor having more than one flow splitter duct according to claim 5 wherein the area of the ducts is increased towards the low pressure side of the flow splitter.

* * * * *